US008505325B2

(12) United States Patent
Kang et al.

(10) Patent No.: US 8,505,325 B2
(45) Date of Patent: Aug. 13, 2013

(54) ICE-MAKING ASSEMBLY FOR REFRIGERATOR

(75) Inventors: Byeong-Gyu Kang, Changwon (KR); Jae-Youl Lee, Changwon (KR); Sang-Ho Park, Changwon (KR)

(73) Assignee: LG Electronics Inc., Seoul (KR)

( * ) Notice: Subject to any disclaimer, the term of this patent is extended or adjusted under 35 U.S.C. 154(b) by 593 days.

(21) Appl. No.: 12/668,054

(22) PCT Filed: Jun. 27, 2008

(86) PCT No.: PCT/KR2008/003717
§ 371 (c)(1),
(2), (4) Date: Oct. 4, 2010

(87) PCT Pub. No.: WO2009/008608
PCT Pub. Date: Jan. 15, 2009

(65) Prior Publication Data

US 2011/0016905 A1 Jan. 27, 2011

(30) Foreign Application Priority Data

Jul. 12, 2007 (KR) ..... 10-2007-0069899

(51) Int. Cl.
*F25C 1/22* (2006.01)

(52) U.S. Cl.
USPC ..... 62/340; 62/349

(58) Field of Classification Search
USPC ..... 62/340, 344, 349, 353, 342
See application file for complete search history.

(56) References Cited

U.S. PATENT DOCUMENTS

| | | | | | |
|---|---|---|---|---|---|
| 2,510,400 | A | * | 6/1950 | Hurley | 62/137 |
| 2,990,697 | A | * | 7/1961 | Buzicky | 62/345 |
| 3,146,601 | A | * | 9/1964 | Gould | 62/3.6 |
| 4,055,053 | A | * | 10/1977 | Elfving et al. | 62/3.63 |
| 4,088,243 | A | * | 5/1978 | Deveson | 221/93 |
| 4,898,002 | A | * | 2/1990 | Taylor | 62/71 |
| 5,014,523 | A | * | 5/1991 | Kohl | 62/347 |
| 5,230,448 | A | * | 7/1993 | Strohmeyer et al. | 222/643 |

(Continued)

FOREIGN PATENT DOCUMENTS

| | | | |
|---|---|---|---|
| KR | 10-2000-0027232 | A | 5/2000 |
| KR | 10-2000-0061207 | A | 10/2000 |
| KR | 10-2005-0063871 | A | 6/2005 |
| KR | 10-0719255 | B1 | 5/2007 |

OTHER PUBLICATIONS

PCT International Search Report dated Jan. 21, 2009 for Application No. PCT/KR2008/003717, 2 pages.

*Primary Examiner* — Mohammad M Ali
(74) *Attorney, Agent, or Firm* — Fish & Richardson P.C.

(57) ABSTRACT

An ice-making assembly for a refrigerator is provided. The ice-making assembly includes a tray for making ice, a handling member for rotating the tray, a first rotation member rotatable with the handling member, a second rotation member rotating the tray, and a transmission member for transmitting rotation of the first rotation member to the second rotation member. An end of the transmission member is fixed to first rotation member, and the other end of the transmission member is fixed to the second rotation member. A force is transmitted from the handling member (a lever) to the tray through the transmission member, which has a strip shape and is coupled to or wound around the rotation member. Therefore, freezing between the transmission member and the rotation member can be minimized, and the lever can be smoothly handled. Thus, a force applied to the lever can be smoothly transmitted to the tray.

23 Claims, 5 Drawing Sheets

(56) References Cited

U.S. PATENT DOCUMENTS 6,438,976 B2 * 8/2002 Shapiro et al. ..... 62/135
6,953,132 B2 * 10/2005 McCann et al. ..... 222/108
7,013,657 B2 * 3/2006 Hwang et al. ..... 62/137
7,104,291 B2 * 9/2006 Dalton et al. ..... 141/82
7,137,271 B2 * 11/2006 Hawkes et al. ..... 62/344

* cited by examiner

ICE-MAKING ASSEMBLY FOR REFRIGERATOR

TECHNICAL FIELD

The present disclosure relates to an ice-making assembly for a refrigerator.

BACKGROUND ART

In general, an ice-making assembly is disposed in a main body or door of a refrigerator for making ice.

Such an ice-making assembly includes an outer case, an ice-making unit, a water container, and an ice bank. The outer case forms the exterior of the ice-making assembly, and the ice-making unit is disposed at the outer case. The water container supplies water to the ice-making unit, and the ice bank stores ice made by the ice-making unit.

The ice-making unit includes an ice-making case, at least one tray, a lever, and a power transmitter. The tray is rotatable disposed at the ice-making case, and the lever is used for rotating the tray. The power transmitter transmits a rotation force from the lever to the tray. The power transmitter may include a plurality of gears.

However, in the case where the power transmitter includes a plurality of gears, water can permeate between the gears of the power transmitter. Then, the wafer may freeze between the gears. This makes it difficult to handle the lever and causes rough operations of the gears.

DISCLOSURE OF INVENTION

Technical Problem

Accordingly, embodiments provide an ice-making assembly for a refrigerator, in which a tray can be smoothly rotated by handling a lever.

Embodiments also provide an ice-making assembly for a refrigerator, which is configured to transmit a force applied to a lever to a tray smoothly.

Technical Solution

In one embodiment, there is provided an ice-making assembly for a refrigerator, the ice-making assembly including: a tray at which ice is made; a handling member configured to rotate the tray; a first rotation member rotatable with the handling member; a second rotation member rotating the tray; and a transmission member configured to transmit a rotation of the first rotation member to the second rotation member, wherein an end of the transmission member is fixed to first rotation member, and the other end of the transmission member is fixed to the second rotation member.

In another embodiment, there is provided an ice-making assembly for a refrigerator, the ice-making assembly including: a plurality of trays at which ice is made; a lever configured to be handled for rotating the trays; a first rotation member rotatable with the lever; a tray rotation member configured to receive a rotation force from the first rotation member for rotating the trays; and a transmission member configured to transmit a rotation force from the first rotation member to the tray rotation member.

In another embodiment, there is provided an ice-making assembly for a refrigerator, the ice-making assembly including: a tray at which ice is made; a lever configured to rotate the tray; a lever rotation member rotatable with the lever; a tray rotation member configured to rotate the tray; and a strip-shaped transmission member configured to transmit a force applied to the lever to the tray.

Advantageous Effects

According to the present discloser, a force applied to the handling member (i.e., a lever) is transmitted to the tray through the transmission member, which has a strip shape and is coupled to the rotation member or wound around the rotation member. Therefore, freezing between the transmission member and the rotation member can be minimized, and thus the lever can be smoothly handled. As a result, a force applied to the lever can be smoothly transmitted to the tray.

MODE FOR THE INVENTION

Reference will now be made in detail to the embodiments of the present disclosure, examples of which are illustrated in the accompanying drawings.

Figure 1:
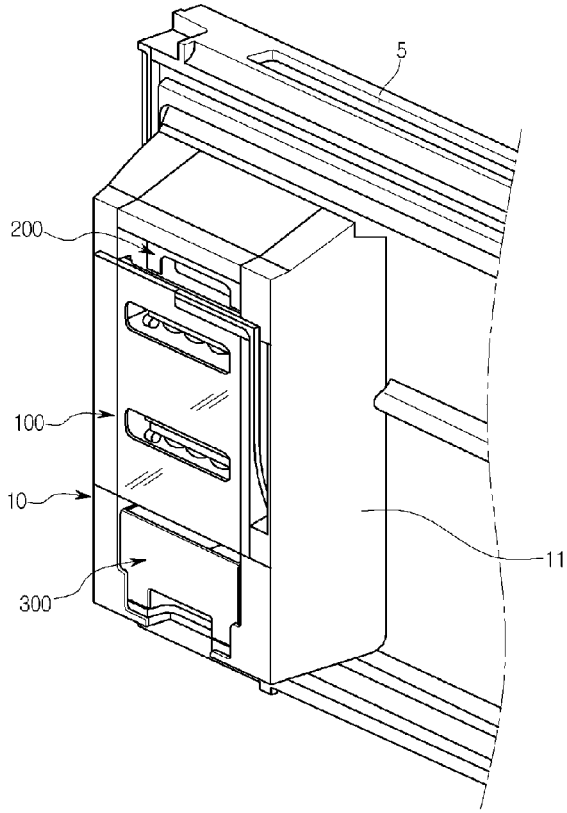
FIG. 1 is a perspective view illustrating an ice-making assembly coupled to a refrigerator door according to a first embodiment.

FIG. 1 is a perspective view illustrating an ice-making assembly 10 coupled to a refrigerator door 5 according to a first embodiment.

Referring to FIG. 1, the ice-making assembly 10 of the first embodiment is coupled to an inner surface of the refrigerator door 5. The ice-making assembly 10 makes ice using cold air. For this, the refrigerator door 5 may be a freezer compartment door of a refrigerator. Alternatively, the refrigerator door 5 may be a refrigerator compartment door of a refrigerator. In the latter case, an additional structure may be provided to supply cold air to the ice-making assembly 10.

In detail, the ice-making assembly 10 includes an outer case 11, an ice-making unit 100, a water container 200, and an ice bank 300. The outer case 11 forms the exterior of the ice-making assembly 10. The ice-making unit 100 is disposed in the outer case 11. The water container 200 is disposed above the ice-making unit 100 and stores water to supply it to the ice-making unit 100. The first liner layer 300 is disposed under the ice-making unit 100 for storing ice made by the ice-making unit 100.

The water container 200 and the ice bank 300 are slidably assembled to the ice-making assembly 10 so that the water container 200 and the ice bank 300 can be detached from the ice-making assembly 10 by sliding them backward.

An exemplary operation of the ice-making assembly 10 will now be described in brief.

If a user wants to make ice, he/she fills the water container 200 with water. Thereafter, he/she can couple the water container 200 to the ice-making assembly 10. Then, the water filled in the water container 200 is supplied to the ice-making unit 100 through a predetermined passage.

The water supplied to the ice-making unit 100 is frozen by cold air introduced into the ice-making unit 100. Then, the user can handle the ice-making unit 100 to discharge ice from the ice-making unit 100 to the ice bank 300. Ice can be easily taken out of the ice bank 300 after detaching the ice bank 300 from the ice-making assembly 10.

The ice-making unit 100 will now be described in more detailed in accordance with the first embodiment.

Figure 2:
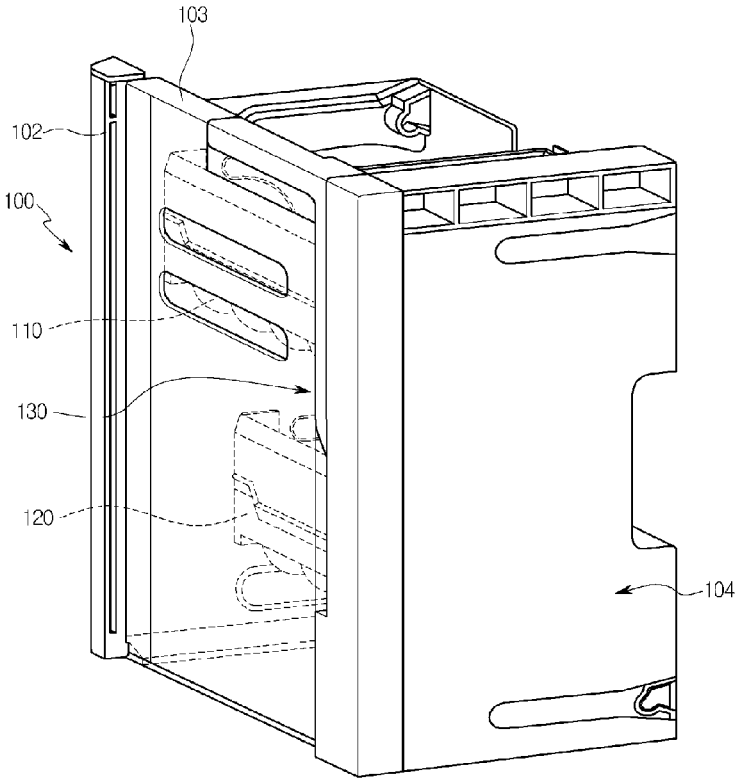
FIG. 2 is a perspective view illustrating an ice-making unit of the ice-making assembly according to the first embodiment.

FIG. 2 is a perspective view illustrating the ice-making unit 100 of the first embodiment.

Referring to FIG. 2, the ice-making unit 100 includes an ice-making case 102, a front cover 103, a plurality of trays 110 and 120, a lever 130, a power transmitter 140 (refer to FIG. 3), and a side cover 104. The front cover 103 is coupled to a front side of the ice-making case 102. The trays 110 and 120 are rotatably disposed in the ice-making case 102. The lever 130 is used as a handling member for rotating the lower tray 120. That is, the trays 110 and 120 can be rotated by handling the lever 130. A torque applied to the lever 130 is transmitted to the trays 110 and 120 through the power transmitter. The side cover 104 is coupled to a side of the ice-making case 102 to cover the power transmitter 140.

In detail, the trays 110 and 120 are disposed at different heights. The tray 110 is an upper tray, and the tray 120 is a lower tray. A rotation shaft 122 (refer to FIG. 4) of the lower tray 120 is disposed backward from a rotation shaft 112 (refer to FIG. 4) of the upper tray 110 so as to prevent ice from falling from the upper tray 110 to the lower tray 120 when the upper tray 110 is rotated.

The power transmitter 140 is configured such that the lower and upper trays 110 and 120 can be rotated in the same direction as the rotation direction of the lever 130.

The power transmitter 140 will now be described in more detail.

Figure 3:
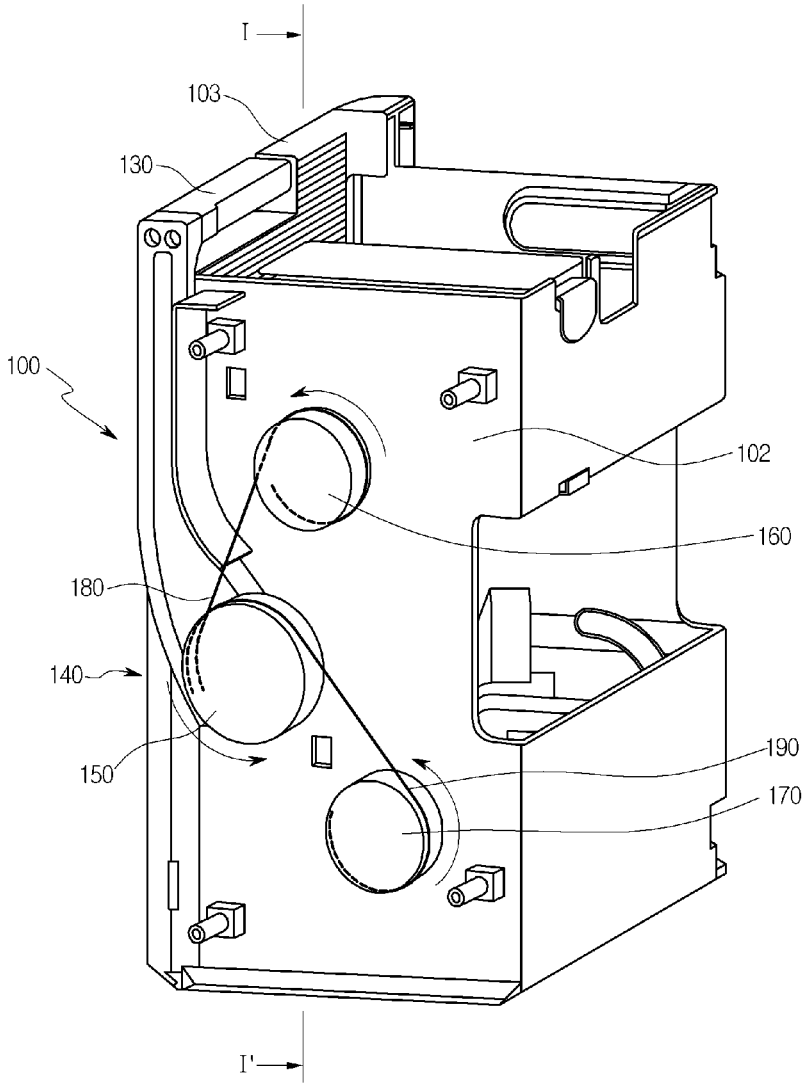
FIG. 3 is a perspective view illustrating the ice-making unit after detaching a side cover from the ice-making unit.
Figure 4:
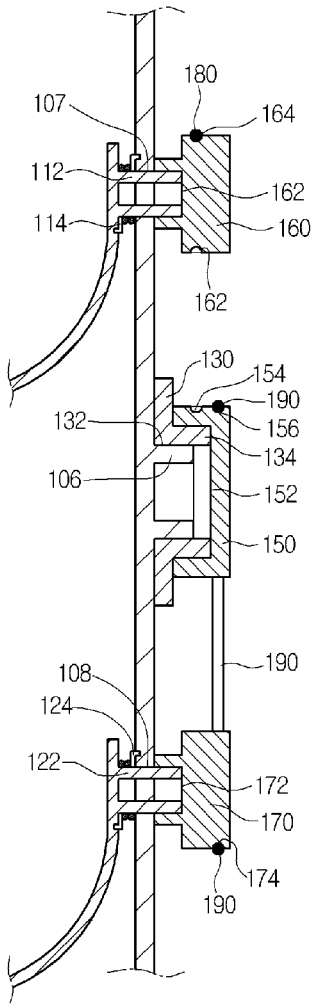
FIG. 4 is a sectional view taken from line I-I' of FIG. 3.

FIG. 3 is a perspective view illustrating the ice-making unit 100 after detaching the side cover 104 from the ice-making unit 100, and FIG. 4 is a sectional view taken from line I-I' of FIG. 3.

Referring to FIGS. 3 and 4, the power transmitter 140 of the current embodiment includes a first rotation member 150, a second rotation member 160, a third rotation member 170, a first transmission member 180, and a second transmission member 190. The first rotation member 150 is coupled to the lever 130 and is rotatable with the lever 130. The second rotation member 160 is coupled to the upper tray 110. The third rotation member 170 is coupled to the lower tray 120. The first transmission member 180 is configured to transmit a rotation force from the first rotation member 150 to the second rotation member 160. The second transmission member 190 is configured to transmit a rotation force from the second rotation member 160 to the third rotation member 170.

In detail, a coupling protrusion 106 is disposed on a side of the ice-making case 102, and the lever 130 is coupled to the coupling protrusion 106. An insertion hole 132 is formed in the lever 130 for receiving the coupling protrusion 106.

The coupling protrusion 106 and the insertion hole 132 may have a circular shape to allow smooth rotation of the lever 130 in a state where the coupling protrusion 106 is inserted in the insertion hole 132 of the lever 130.

The lever 130 includes a coupling portion 134 for coupling with the first rotation member 150. The first rotation member 150 includes a coupling groove 152 for coupling with the coupling portion 134 of the lever 130. Since the first rotation member 150 is coupled with the lever 130, the first rotation member 150 can be referred to as "a lever rotation member."

The coupling portion 134 of the lever 130 is coupled to the coupling groove 152 of the first rotation member 150. In this state, the lever 130 may be rotated to rotate the first rotation member 150. For this, the coupling portion 134 and the coupling groove 152 may have a polygonal shape. That is, when the coupling portion 134 and the coupling groove 152 have a polygonal shape, slipping between the lever 130 and the first rotation member 150 can be effectively prevented.

In the current embodiment, the first rotation member 150 is coupled to the lever 130. However, the first rotation member 150 and the lever 130 may be formed in one piece in other embodiments.

The rotation shafts 112 and 122 of the lower and upper trays 110 and 120 are inserted through the ice-making case 102. Penetration holes 107 and 108 are formed in the ice-making case 102 for receiving the rotation shafts 112 and 122 of the lower and upper trays 110 and 120.

The second rotation member 160 is coupled to the rotation shaft 112 inserted through the ice-making case 102, and the third rotation member 170 is coupled to the rotation shaft 122 inserted through the ice-making case 102. The second rotation member 160 includes a shaft coupling groove 162 for receiving the rotation shaft 112, and the third rotation member 170 includes a shaft coupling groove 172 for receiving the rotation shaft 122.

Since the second and third rotation members 160 and 170 are coupled to the lower and upper trays 110 and 120, the second and third rotation members 160 and 170 can be referred to as "tray rotation members."

In a state where the rotation shafts 112 and 122 are coupled to the shaft coupling grooves 162 and 172, the second and third rotation members 160 and 170 are rotated to rotate the lower and upper trays 110 and 120. For this, the rotation shafts 112 and 122, and the shaft coupling grooves 162 and 172 may have a polygonal shape.

First and second elastic members 114 and 124 are disposed at an inner side of the ice-making case 102 so that after the lower and upper trays 110 and 120 are rotated by the lever 130, the lower and upper trays 110 and 120 can be returned to their original positions.

In detail, an end of the first elastic member 114 is fixed to the lower tray 110, and the other end of the first elastic member 114 is fixed to the ice-making case 102. An end of the second elastic member 124 is fixed to the upper tray 120, and the other end of the second elastic member 124 is fixed to the ice-making case 102. The first elastic member 114 is wound around the rotation shaft 112 of the lower tray 110, and the second elastic member 124 is wound around the rotation shaft 122 of the upper tray 120.

The first and second transmission members 180 and 190 are shaped like a wire or a strip and are flexible. An end of the first transmission member 180 is coupled to the first rotation member 150, and the other end of the first transmission member 180 is coupled to the second rotation member 160.

An end of the second transmission member 190 is coupled to the first rotation member 150, and the other end of the second transmission member 190 is coupled to the third rotation member 170.

The first and second transmission members 180 and 190 can be coupled to the first, second, and third rotation members 150, 160, and 170 by any method. For example, the first and second transmission members 180 and 190 may be coupled to the first, second, and third rotation members 150, 160, and 170 by inserting ends of the first and second transmission members 180 and 190 into insertion grooves formed in the first, second, and third rotation members 150, 160, and 170.

The first and second transmission members 180 and 190 are partially wound around the first, second, and third rotation members 150, 160, and 170. When the first rotation member 150 is rotated in a predetermined direction, the first transmission member 180 is unwound from the second rotation member 160 and is wound around the first rotation member 150. In addition, when the first rotation member 150 is rotated in the predetermined direction, the second transmission member 190 is unwound from the third rotation member 170 and is wound around the first rotation member 150. That is, when a rotation of the first rotation member 150 is transmitted through the first and second transmission members 180 and 190, the shapes and positions of the first and second transmission members 180 and 190 are changed.

For example, when the lever 130 is pulled for separating ice from the upper and lower trays 110 and 120, the first rotation member 150 may be rotated in the predetermined direction. In the embodiment shown in FIG. 3, the predetermined direction is a counterclockwise direction.

As mentioned above, when the first rotation member 150 is rotated in the predetermined direction, the first and second transmission members 180 and 190 are wound around the first rotation member 150. Therefore, the second and third rotation members 160 and 170 can be rotated in the same direction as the first rotation member 150.

The first and second rotation members 150 and 160 include first accommodation grooves 154 and 164 for receiving the first transmission member 180. In addition, the first and third rotation members 150 and 170 include second accommodation grooves 156 and 174 for receiving the second transmission member 190. The first and second accommodation grooves 154, 156, 164, and 174 are formed along the circumferences of the first to third rotation members 150, 160, and 170.

The first and second accommodation grooves 154 and 156 of the first rotation member 150 are spaced apart from each other. The first and second accommodation grooves 154 and 156 may be parallel with each other.

To prevent interference between the first and second transmission members 180 and 190, the first accommodation groove 154 of the first rotation member 150 may be aligned with the first accommodation groove 164 of the second rotation member 160, and the second accommodation groove 156 of the first rotation member 150 may be aligned with the second accommodation groove 174 of the third rotation member 170.

Owing to the first and second accommodation grooves 154, 156, 164, and 174, a rotation of the first rotation member 150 can be smoothly transmitted to the second and third rotation members 160 and 170 through the first and second transmission members 180 and 190.

The first and second accommodation grooves 154, 156, 164, and 174 have a shape corresponding to the first and second transmission members 180 and 190. The first and second transmission members 180 and 190 may be partially inserted in the first and second accommodation grooves 154, 156, 164, and 174 for minimizing freezing therebetween.

An exemplary operation of the ice-making unit 100 will now be described.

A user can pull the lever 130 to separate ice from the upper and lower trays 110 and 120. Then, the lever 130 is rotated counterclockwise as shown in FIG. 3, and the first rotation member 150 is also rotated counterclockwise together with the lever 130.

As the first rotation member 150 is rotated counterclockwise, the first transmission member 180 is unwound from the second rotation member 160 and is wound around the first rotation member 150 such that the second rotation member 160 is rotated counterclockwise.

At the same time, the second transmission member 190 is unwound from the third rotation member 170 and is wound around the first rotation member 150 such that the third rotation member 170 is rotated counterclockwise.

In this way, the second and third rotation members 160 and 170 are rotated counterclockwise, and thus the upper and lower trays 110 and 120 are rotated counterclockwise. As a result, ice can fall from the upper and lower trays 110 and 120 to the ice bank 300.

Thereafter, if the pulled lever 130 is released, the upper and lower trays 110 and 120 are rotated clockwise by the resilience of the first and second elastic members 114 and 124.

As the lower tray 110 is rotated clockwise, the first transmission member 180 is unwound from the first rotation member 150 and is wound around the second rotation member 160, and thus the first and second rotation members 150 and 160 are rotated clockwise.

As the upper tray 120 is rotated clockwise, the second transmission member 190 is unwound from the first rotation member 150 and is wound around the third rotation member 170, and thus the first and third rotation members 150 and 170 are rotated clockwise.

According to the current embodiment, a rotation of the first rotation member 150 is transmitted to the second and third rotation members 160 and 170 through the first and second transmission members 180 and 190 connected among the first to third rotation members 150, 160, and 170. Therefore, the rotation of the first rotation member 150 can be smoothly transmitted to the second and third rotation members 160 and 170.

In addition, since the first and second transmission members 180 and 190 are partially inserted in the first and second accommodation grooves 154, 156, 164, and 174, the possibility of freezing can be reduced at the first and second accommodation grooves 154, 156, 164, and 174.

Although freezing occurs between the first and second accommodation grooves 154, 156, 164, and 174 and the first and second transmission members 180 and 190, the first and second transmission members 180 and 190 can be easily released from the first and second accommodation grooves 154, 156, 164, and 174 owing to small interface areas between the first and second accommodation grooves 154, 156, 164, and 174 and the first and second transmission members 180 and 190. Therefore, the second and third rotation members 160 and 170 can be smoothly rotated.

Moreover, since the first to third rotation members 150, 160, and 170 are smoothly rotated, the lever 130 can be conveniently handled.

Figure 5:
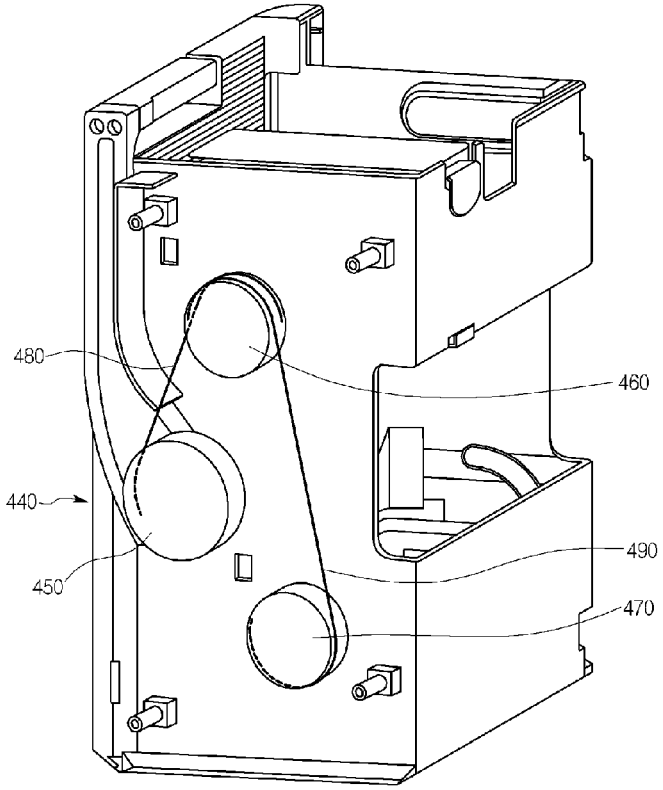
FIG. 5 is a side perspective view illustrating an ice-making unit and a power transmitter of the ice-making unit according to a second embodiment.

FIG. 5 is a side perspective view illustrating an ice-making unit and a power transmitter 440 of the ice-making unit according to a second embodiment.

The power transmitter 440 of the second embodiment has the same structure as that of the power transmitter 140 of the first embodiment except for coupling positions of power transmission members. Thus, in the following description, the difference will now be mainly described, and the same elements will not be described again.

Referring to FIG. 5, the power transmitter 440 of the current embodiment includes a first rotation member 450, a second rotation member 460, a third rotation member 470, a first transmission member 480, and a second transmission member 490. The first rotation member 450 is coupled to the lever 130 and is rotatable with the lever 130. The second rotation member 460 is coupled to the upper tray 110. The third rotation member 470 is coupled to the lower tray 120. The first transmission member 480 is configured to transmit a rotation force from the first rotation member 450 to the second rotation member 460. The second transmission member 490 is configured to transmit a rotation force from the second rotation member 460 to the third rotation member 470.

In detail, an end of the first transmission member 480 is coupled to the first rotation member 450, and the other end of the first transmission member 480 is coupled to the second rotation member 460. An end of the second transmission member 490 is coupled to the second rotation member 460, and the other end of the second transmission member 490 is coupled to the third rotation member 470.

When a user pulls the lever 130, the lever 130 is rotated counterclockwise as shown in FIG. 5, and the first rotation member 450 is rotated counterclockwise together with the lever 130.

As the first rotation member 450 is rotated counterclockwise, the first transmission member 480 is unwound from the second rotation member 460 and is wound around the first rotation member 450. Thus, the second rotation member 460 is rotated counterclockwise.

As the second rotation member 460 is rotated counterclockwise, the second transmission member 490 is unwound from the third rotation member 470 and is wound around the second rotation member 460. Thus, the third rotation member 470 is rotated counterclockwise.

Therefore, as the second and third rotation members 460 and 470 are rotated counterclockwise, the upper and lower trays 110 and 120 are rotated counterclockwise.

Figure 6:
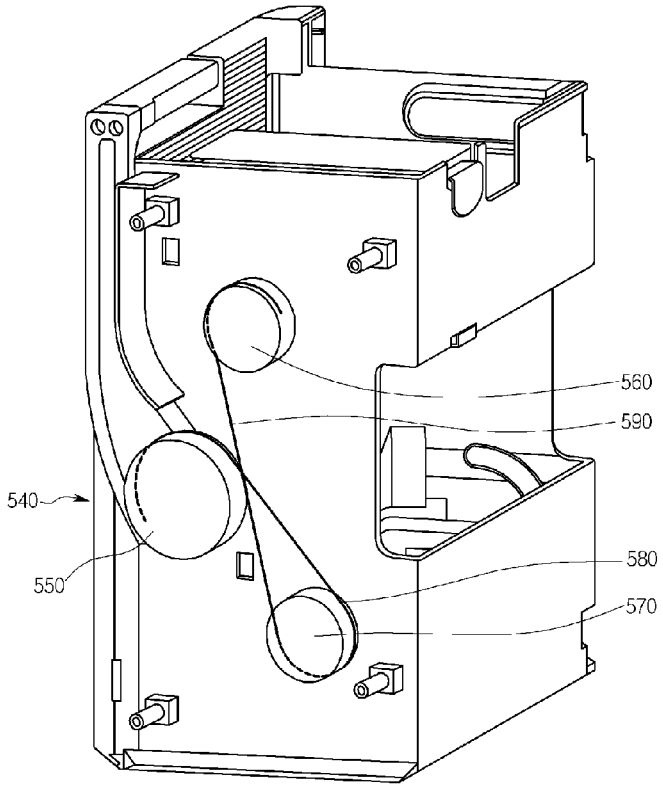
FIG. 6 is a side perspective view illustrating an ice-making unit and a power transmitter of the ice-making unit according to a third embodiment.

FIG. 6 is a side perspective view illustrating an ice-making unit and a power transmitter 540 of the ice-making unit according to a third embodiment.

The power transmitter 540 of the third embodiment has the same structure as that of the power transmitter 140 of the first embodiment except for coupling positions of power transmission members. Thus, in the following description, the difference will now be mainly described, and the same elements will not be described again.

Referring to FIG. 6, the power transmitter 540 of the current embodiment includes a first rotation member 550, a second rotation member 560, a third rotation member 570, a first transmission member 580, and a second transmission member 590. The first rotation member 550 is coupled to the lever 130 and is rotatable with the lever 130. The second rotation member 560 is coupled to the upper tray 110. The third rotation member 570 is coupled to the lower tray 120. The first transmission member 580 is configured to transmit a rotation force from the first rotation member 550 to the third rotation member 570. The second transmission member 590 is configured to transmit a rotation force from the third rotation member 570 to the second rotation member 560.

In detail, an end of the first transmission member 580 is coupled to the first rotation member 550, and the other end of the first transmission member 580 is coupled to the third rotation member 570. An end of the second transmission member 590 is coupled to the third rotation member 570, and the other end of the second transmission member 590 is coupled to the second rotation member 560.

When a user pulls the lever 130, the lever 130 is rotated counterclockwise as shown in FIG. 6, and the first rotation member 550 is rotated counterclockwise together with the lever 130.

As the first rotation member 550 is rotated counterclockwise, the first transmission member 580 is unwound from the third rotation member 570 and is wound around the first rotation member 450. Thus, the third rotation member 570 is rotated counterclockwise.

As the third rotation member 570 is rotated counterclockwise, the second transmission member 590 is unwound from the second rotation member 560 and is wound around the third rotation member 570. Thus, the second rotation member 560 is rotated counterclockwise.

Therefore, as the second and third rotation members 560 and 570 are rotated counterclockwise, the upper and lower trays 110 and 120 are rotated counterclockwise.

Figure 7:
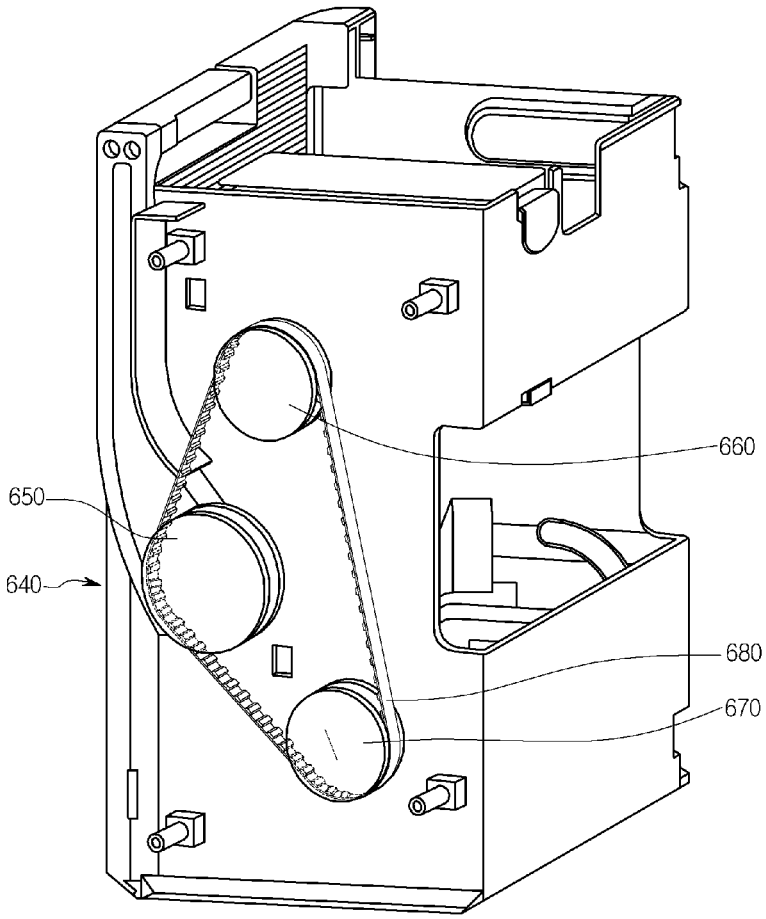
FIG. 7 is a side perspective view illustrating an ice-making unit and a power transmitter of the ice-making unit according to a fourth embodiment.

FIG. 7 is a side perspective view illustrating an ice-making unit and a power transmitter 640 of the ice-making unit according to a fourth embodiment.

The power transmitter 640 of the third embodiment has the same structure as that of the power transmitter 140 of the first embodiment except for the number of power transmission members. Thus, in the following description, the difference will now be mainly described, and the same elements will not be described again.

Referring to FIG. 7, the power transmitter 640 of the current embodiment includes a first rotation member 650, a second rotation member 660, a third rotation member 670, and a transmission member 680. The first rotation member 650 is coupled to the lever 130 and is rotatable with the lever 130. The second rotation member 660 is coupled to the upper tray 110. The third rotation member 670 is coupled to the lower tray 120. The transmission member 680 is configured to transmit a rotation force from the first rotation member 650 to the second and third rotation members 660 and 670.

In detail, the transmission member 680 is wound around the first to third rotation members 650, 660, and 670. The transmission member 680 may be a timing belt. In this case, a rotation of the first rotation member 650 may be smoothly transmitted to the second and third rotation members 660 and 670.

The circumferences of the first to third rotation members 650, 660, and 670 may have a concave-convex surface structure corresponding to an inner surface structure of the timing belt.

When the transmission member 680 is wound around the first to third rotation members 650, 660, and 670, the transmission member 680 may protrude from the first to third rotation members 650, 660, and 670 so as to minimize freezing between the transmission member 680 and the first to third rotation members 650, 660, and 670.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An ice-making assembly for a refrigerator, comprising:

a plurality of trays at which ice is made;

a lever configured to be handled for rotating the trays;

a first rotation member rotatable with the lever;

a tray rotation member configured to receive a rotation force from the first rotation member for rotating the trays; and a transmission member configured to transmit a rotation force from the first rotation member to the tray rotation member, wherein the trays comprise an upper tray and a lower tray that are disposed at different heights, and a rotation shaft of the lower tray is disposed backward from a rotation shaft of the upper tray.

2. The ice-making assembly according to claim 1, wherein the tray rotation member comprises second and third rotation members configured to rotate the trays, respectively.

3. The ice-making assembly according to claim 2, wherein the transmission member comprises:

a first transmission member connecting the first and second rotation members; and a second transmission member connecting the first and third rotation members.

4. The ice-making assembly according to claim 3, wherein the first rotation member comprises a plurality of accommodation grooves configured to receive at least a portion of the first transmission member and at least a portion of the second transmission member, respectively.

5. The ice-making assembly according to claim 4, wherein the accommodation grooves are arranged along a circumference of the first rotation member in parallel with each other.

6. The ice-making assembly according to claim 2, wherein the transmission member comprises: a first transmission member connecting the first and second rotation members; and a second transmission member connecting the second and third rotation members.

7. The ice-making assembly according to claim 2, wherein the transmission member is wound around the first, second, and third rotation members.

8. The ice-making assembly according to claim 7, wherein the transmission member is a timing belt.

9. The ice-making assembly according to claim 2, wherein when ice is separated from the trays, the first, second, and third rotation members are rotated in the same direction.

10. An ice-making assembly for a refrigerator, comprising:

a tray at which ice is made;

a lever configured to rotate the tray;

a lever rotation member rotatable with the lever;

a tray rotation member configured to rotate the tray; and a strip-shaped transmission member configured to transmit a force applied to the lever to the tray, wherein the tray is provided in plurality, and the tray rotation member is provided in plurality, wherein the number of the tray rotation members corresponds to the number of the trays, and wherein the transmission member is wound around the lever rotation member and the tray rotation members.

11. The ice-making assembly according to claim 10, wherein the transmission member comprises:

a first transmission member comprising an end fixed to the lever rotation member and the other end fixed to one of the tray rotation members; and a second transmission member comprising an end fixed to the lever rotation member and the other end fixed to another of the tray rotation members.

12. The ice-making assembly according to claim 10, wherein the transmission member comprises:

a first transmission member comprising an end fixed to the lever rotation member and the other end fixed to one of the tray rotation members; and a second transmission member comprising an end fixed to the tray rotation member to which the end of the first transmission member is fixed, and the other end fixed to another of the tray rotation members.

13. An ice making assembly for a refrigerator, comprising:

a first tray rotatable with respect to a first rotation axis;

a second tray rotatable with respect to a second rotation axis, the second tray located below the first tray;

a handling member configured to rotate the first tray and the second tray;

a first rotation member rotating together with the handling member, the handling member extending from the first rotation member in a direction perpendicular to a rotational axis of the first rotation member;

a second rotation member coupled to the first rotation axis;

a third rotation member coupled to the second rotation axis; and a transmission member configured to transmit a rotational movement of the first rotation member to the second and third rotation members, respectively.

14. The ice making assembly of claim 13, wherein the second rotation axis is disposed backward from the first rotation axis.

15. The ice making assembly of claim 14, wherein the transmission member includes:

a first transmission member connecting the first rotation member and the second rotation member; and a second transmission member connecting the first rotation member and the third rotation member.

16. The ice making assembly of claim 14, wherein the transmission member includes:

a first transmission member connecting the first rotation member and the second rotation member; and a second transmission member connecting the second rotation member and the third rotation member.

17. The ice making assembly of claim 14, wherein the transmission member includes:

a first transmission member connecting the first rotation member and the third rotation member; and a second transmission member connecting the second rotation member and the third rotation member.

18. The ice making assembly of claim 14, wherein the transmission member includes a belt which is wound on the first, second, and third rotation members.

19. The ice making assembly of claim 14, wherein at least a portion of the transmission member is wound around the first, second, and third rotation members.

20. The ice making assembly of claim 14, wherein the transmission member has a strip shape.

21. The ice making assembly of claim 14, wherein each rotation member comprises an accommodation groove along a circumference thereof, for receiving the transmission member.

22. The ice making assembly of claim 14, wherein the first rotation member is formed in one piece with the handling member or is coupled to the handling member.

23. The ice-making assembly according to claim 14, wherein the first rotation member, the second rotation member, and the third rotation member are rotated in the same direction.

* * * * *